United States Patent [19]

Miller

[11] 3,944,112

[45] Mar. 16, 1976

[54] MUSTACHE CUP ADAPTOR

[76] Inventor: George W. Miller, 799 Shawmut Ave., New Bedford, Mass. 02746

[22] Filed: Feb. 3, 1975

[21] Appl. No.: 546,561

[52] U.S. Cl. ..... 220/90.2

[51] Int. Cl.[2] ..... A47G 19/22

[58] Field of Search ..... 220/90.2, 90.4, 90.6

[56] References Cited

UNITED STATES PATENTS

| | | | |
|---|---|---|---|
| 927,892 | 7/1909 | Steele, Jr. | 220/90.2 |
| 3,800,999 | 4/1974 | Serritella | 220/90.4 X |
| 3,868,043 | 2/1975 | Freemyer | 220/90.4 |

*Primary Examiner*—William Price
*Assistant Examiner*—Steven M. Pollard

[57] ABSTRACT

A plastic adaptor having the form of a flat band with a tubular arc edge which snaps on the rim of a conventional drinking cup. When in place the adaptor permits a person to drink but prevents the liquid within the cup from coming in contact with the drinker's moustache; thereby converting any conventional drinking cup into a typical moustache cup.

1 Claim, 1 Drawing Figure

MUSTACHE CUP ADAPTOR

Figure 1:
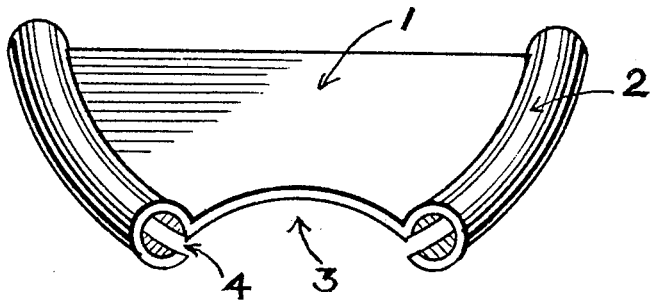
FIG. 1, is a top perspective view of the adaptor.

Numeral 1 is the segmental shaped flat thin plastic plane of the adaptor. Numeral 2 is the slit flexible tubular arc edge. Numeral 3 is the segmental shaped opening in the arc edge. Numeral 4 indicates the slit in the underside of the arc edge.

DETAILED DESCRIPTION OF THE PREFERRED EMBODIMENT

Referring to the drawing in detail, the reference numeral 1 is the segmental shaped flat thin plastic plane of the adaptor. Numeral 2 is the slit flexible arc edge which snaps on, and tightly conforms to the rim of a cup. Numeral 3 is the arcuate opening in the tubular arc edge of the adaptor which permits liquid to flow from the cup when the cup is tilted for drinking. Numeral 4 indicates the slit in the underside of the flexible tubular arc edge of the adaptor which allows the adaptor to be placed securely on the rim of a cup.

DETAILED DESCRIPTION

The principal object of this invention is to permit the user to snap this adaptor on to the rim of a conventional drinking cup, thereby enabling the user to drink from the cup without having the liquid within the cup come into contact with the user's moustache. In operative use the adaptor is snapped on the rim of a cup with the segmental shaped opening 3 in the arc edge of the adaptor facing the user. As the cup is tilted for drinking the liquid therein contained flows through the opening 3. The user's mouth is placed at the opening 3 permitting drinking but preventing the liquid from coming into contact with the user's moustache which is resting on the segmental shaped flat thin plastic plane 1 of the adaptor.

An object of this adaptor is to have the slit flexible tubular arc edge of the adaptor so constructed that it conforms to and fits tightly on the rim of a cup.

Another object of this adaptor is to have the tubular arc edge so slit on the underside to permit the adaptor to be placed firmly on the rim of a cup.

Yet another object of the invention is to have the segmental shaped opening 3 in the tubular arc edge of the adaptor on the center third of the tubular arc edge to permit the rim of a cup to be exposed when the adaptor is snapped on the cup.

Another object of the invention is to have the segmental shaped opening 3 in the tubular arc edge 2 of the adaptor to be one third of the total width of the segmental shaped flat thin plastic plane 1 of the adaptor.

Still another object of the invention is to have the adaptor constructed of a material flexible enough to conform to the rim of cups of a variable — but closely related — circumference in which case the flat surface 1 may be either a flat plane or slightly bowed.

A further object of this invention is to have the slit 4 tubular arc edge 2 of the adaptor so constructed that the device can be easily removed from a cup so that it is both cleanable and re-usable.

And still another object of this invention is that it is so designed that it is convenient to use for either a left or right-handed individual.

A modification of this invention is to have the adaptor made of a semi-hard material to fit cups of a definite size or shape.

Yet another modification is to have the adaptor constructed of some material that is disposable.

Still another modification is to have the adaptor so constructed that it will fit specific or variable sized drinking glasses.

None of the above mentioned variations nor any further variations are to violate the spirit and/or scope of the parent invention.

What I claim is:

1. An adaptor which converts a conventional drinking cup to a moustache cup comprising a segmental shaped flat thin plane of flexible material bounded by a slit lengthwise tubular arc edge which fits tightly over the rim of a cup and an arcuate drinking opening, in said plane, whose length is the middle third of the arc edge and whose width is one-third the distance between the chord edge and the arc edge.

* * * * *